US006936798B2

(12) United States Patent
Moreno

(10) Patent No.: US 6,936,798 B2
(45) Date of Patent: Aug. 30, 2005

(54) PROGRAMMABLE DOMESTIC WATER HEATING SYSTEM

(75) Inventor: Benjamin Moreno, Omer (IL)

(73) Assignee: Joseph Tiran, Omer (IL)

( * ) Notice: Subject to any disclaimer, the term of this patent is extended or adjusted under 35 U.S.C. 154(b) by 25 days.

(21) Appl. No.: 10/333,898

(22) PCT Filed: Jul. 23, 2001

(86) PCT No.: PCT/IL01/00678

§ 371 (c)(1),
(2), (4) Date: May 6, 2003

(87) PCT Pub. No.: WO02/10653

PCT Pub. Date: Feb. 7, 2002

(65) Prior Publication Data

US 2003/0183618 A1 Oct. 2, 2003

(30) Foreign Application Priority Data

Jul. 27, 2000 (IL) ..... 137546
Apr. 2, 2001 (IL) ..... 142377

(51) Int. Cl.[7] ..... H05B 1/02

(52) U.S. Cl. ..... 219/492; 219/481; 392/441; 392/498

(58) Field of Search ..... 219/481, 482, 219/483, 492, 497, 509; 392/441, 449, 463, 464, 497, 498

(56) References Cited

U.S. PATENT DOCUMENTS

| | | | | |
|---|---|---|---|---|
| 4,568,821 A | | 2/1986 | Boe | |
| 4,786,782 A | | 11/1988 | Takai et al. | |
| 5,556,564 A | | 9/1996 | Wittner | |
| 5,956,462 A | * | 9/1999 | Langford | 392/449 |
| 6,002,114 A | | 12/1999 | Lee | |

FOREIGN PATENT DOCUMENTS

| | | |
|---|---|---|
| DE | 196 54 681 | 7/1997 |
| DE | 297 19 267 U1 | 1/1998 |
| DE | 198 25 045 | 12/1998 |
| EP | 0 985 892 | 3/2000 |
| FR | 2 539 238 | 7/1984 |
| WO | WO 94/10620 | 5/1994 |

OTHER PUBLICATIONS

Patent Abstracts of Japan & JP 60–30934. "Control Device for Hot Water Storage Type Electrical Water Heater", Feb. 16, 1985.

* cited by examiner

*Primary Examiner*—Thor S. Campbell
(74) *Attorney, Agent, or Firm*—Merchant & Gould P.C.

(57) ABSTRACT

The invention relates to a method for heating water in a domestic water heating system that comprises the steps of: (a) providing a water tank containing mw liters of water; (b) providing at least one temperature sensing unit in said water tank for sensing the temperature of the water in the tank: (c) providing a heating element in said water tank; (d) providing a control unit for activating said heating element, said control unit continuously receiving indication for the water temperature from said temperature sensing unit; (e) providing to said control unit a desired water temperature, and designating a time for using the water at said desired temperature; (f) knowing the current water temperature, the desired water temperature at said designated time, the power of the heating element, and the specific heat of the water, calculating by the control unit the heating period Δt needed for heating the water in the tank from the current temperature as measured by said temperature sensing unit, to the desired temperature; (g) periodically repeating said calculation and updating said calculated period Δt according to changes in the sensed water temperature; and (h) when the designated usage time is approaching, activating the heating element a Δt period before the said designated period.

17 Claims, 7 Drawing Sheets

PROGRAMMABLE DOMESTIC WATER HEATING SYSTEM

FIELD OF THE INVENTION

The field of the invention generally relates to electrical home appliances. More particularly, the invention relates to an improved domestic water heating system.

BACKGROUND OF THE INVENTION

Hot water is an essential commodity in the modern world, and a water heating system is an appliance commonly used in households throughout the world.

In some countries where the price of the energy is negligible, it is common to activate the water heating system all the day, resulting in a significant waste of energy.

In other countries, where energy is relatively expensive, solar energy is used for heating the water. However, the solar energy cannot generally provide hot water 24 hours a day, 365 days a year, and therefore complementary heating involving energy consumption is required. The source of energy for this purpose is, in most cases, electricity or gas.

In order to save energy, activation of the water heating is only as needed. However, in most water heating systems of the prior art, the user is not provided with any indication regarding temperature of the water in the tank, and moreover, he has no indication whatsoever regarding how long the heating system has to be ON in order to provide water in the desired amount and temperature. Generally, this causes the user to activate the heating element of the system a longer time than necessary resulting in a waste of energy, or a shorter time than necessary, resulting in a colder and insufficient amount of water than desired. Furthermore, even after the water heating is presumably completed, the user has no indication of the water temperature in the tank, and must open the tap and wait a relatively long time for regulating the temperature, resulting in a waste of water.

The lack of accurate temperature indication of the water in the tank, and the inability to plan in advance the necessary water amount and temperature causes inconvenience, waste of energy and water. In cases wherein the user constantly activates the water heating throughout the day and night, there is even more energy waste, particularly in times when there is no need for hot water. This energy waste is added to the energy loss resulting from the temperature difference between environment and the water in the tank, which in many cases is significant.

Of course there are times where a user requires a relatively hotter temperature than in other times. In the systems of the prior art, the pre-planning of the water temperature is either unavailable, or unsatisfactory. In conventional water heating systems of the prior art, and particularly for safety purposes, there is an adjustable thermostat mounted in a pocket in the water tank, which senses the water temperature, and disconnects the electrical supply when a pre-assigned maximum temperature is reached. However, in this case, the regular user does not have access to the thermostat, or control over the pre-assigned temperature.

Some other prior art systems comprise a timer, either electrical or mechanical, for setting the duration of the water heating.

FIG. 1 shows a hot water tank 1 commonly used in systems of the prior art. The water tank 1 comprises an electric heating unit 3 for supplying energy to the water. Heating unit 3 is essentially a resistor, heated by an electric current flowing through it, and transferring heat to the surrounding water. The water tank further comprises in its lower part an inlet water pipe 8, and in its upper part an outlet water pipe 9. Two optional water pipes 104 and 105 are included in those standard water tanks that are designed to operate with solar heat collectors. Through pipe 105 cold water leave the tank to a solar collector, and through pipe 104 hot water enter the tank from the solar collector (not shown). Metal flange 2 at the bottom of the tank supports the heating unit 3. Also supported by the flange is a metal sleeve 4, serving as a pocket for a standard thermostat. Insulating layer 5 blocks heat transfer to the surroundings. Thin metal 10 encloses the tank and the insulating layer 5. Remote ON/OFF switch 6, is usually located in an easily accessed place, and generally comprises a red indication that lights up when the switch is ON. When the switch is ON and the water temperature rises to the preset temperature of the thermostat, the thermostat disconnects current to unit 3. When the water temperature falls below said preset temperature, the thermostat reconnects the current to the heating element.

FIG. 1 also shows a prior art system that further comprises a heat concentrator 7 in the water tank. The heat concentrator 7, which is used only in a vertically oriented tank, is a cup-like device made of any suitable material, mechanically connected to the bottom of the water tank. The heat concentrator 7 has openings 19 at its lower part for enabling water passage into it, and at its upper part an additional outlet opening 20. The heat concentrator 7 encloses the heating unit 3 and the thermostat pocket 4. When the heating unit 3 is activated, hot water in concentrator 7 flows to the upper opening 20, and cold water flows through the lower openings 19 to the concentrator, creating water circulation. Layers of hot water are therefore concentrated at the upper part of the water tank. After a long period of heating, all the water in the tank becomes sufficiently hot, and the water temperature in different parts of the tank is relatively homogeneous.

Generally, it is common to use a heat concentrator 7 in water tanks of 80 liters or more.

Prior art

U.S. Pat. No. 6,002,114, filed Sep. 15, 1998, discloses a water heating system which comprises:

1. A water tank with four heating elements;
2. Temperature sensors for checking the temperature at the inlet and outlet of the water tank;
3. A sensor for checking the water flow rate at the inlet pipe of the tank;
4. CPU receiving sensor indications, for activating/deactivating said four heating elements, further comprising a circuitry for detecting failures; and
5. A display panel for showing the user the temperature of the water leaving the tank.

More particularly, U.S. Pat. No. 6,002,114 deals with a commercial heating system having four electric heating elements, and a plurality of sensors. The heating elements are activated according to water temperature at the inlet and outlet of the tank, while further considering the inlet water flow rate.

DE 29719 267 discloses a microprocessor-based controller for an electric water heating system. The front panel of the housing of the controller has several push buttons for setting the desired temperature and various other parameters, for selecting from a function menu, and for activating a rapid heating mode. The controller further comprises a seven-segment display with a temperature bar indicating the thermal state of the heating system.

U.S. Pat. No. 5,556,564 discloses a domestic water heating system having a unit for controlling the water temperature. The said system comprises:

1. Three temperature sensors, a first sensor at the top, next to the outlet of the water from the tank a second in the middle of the tank, and a third at the bottom of the tank next to the water inlet;
2. A display panel showing the temperature measured by the upper sensor, and enabling the user to set the required temperature of water leaving the tank;
3. Two light indicators which deactivate when the middle, and the lower sensors measure temperatures above the set temperature. The light indicators indicate to the user when there is enough water in the tank for use.
4. The hot water tank and the control panel are distant one from the other, and are connected by only two electric wires. The same two electric wires provide the power to the heating element, and transfer the low voltage temperature indication from the upper sensor in the tank to the control panel.

FR 2 539 238 discloses a control method and device for an apparatus for heating a fluid to reach a predetermined temperature. The device comprises a central control unit receiving a signal from a temperature probe which identifies the temperature of the fluid, a storage unit for storing a characteristics data of the apparatus used, and a circuit for setting a predetermined temperature. The invention is particularly useful in electric water heating systems. The system of this patent particularly intends to activate the heating doing low-rate electrical periods, for example, overnight, weekends, etc. This patent identifies the periods of low-cost electric energy in order to activate the heating particularly during these periods. The system follows the expressions: th=(TF'−TD); and 1<K+ta. th is the temperature at the end of the low cost electric energy period. TF' is the time at the end of the low cost electric energy, TD is the present time, K is a factor describing the intensity of the electric power at the heating element and the water volume in the tank. This formula cannot determine the time required for heating the water in the tank. All this is available for one cycle a day. The system also enables manual heat activation for times when the energy cost is higher.

U.S. Pat. No. 4,568,821 discloses still another remote water heating system. The system comprises two water tanks, one tank solar heated, the other heated by electricity, oil or gas. The system comprises two temperature sensors located at the outlet pipes of each water tank. The controller of said system uses a 24-hour clock, and is assembled with solid state electronic components.

All the above prior art systems are designed to provide better control over water heating systems, and to save energy. Some of the prior art systems allow the designating of a period for heating with a starting time. However, these systems do not consider the water temperature at the starting time for heating, in which the water is heated for the said designated period, resulting in hotter water than necessary (and waste of energy) or colder than necessary (resulting in inconvenience). In some other cases, the water reaches the desired temperature before the time planned for use, and the heating terminates. However, until the water is actually used, the temperature decreases, resulting in a waste of energy and inconvenience. The water heating system of the invention provides more energy and water saving in comparison with the prior art water heating systems, a manner for efficient installation, and also more convenience for the hot water user.

The present invention also discloses a new, efficient and easy manner of assembling temperature sensing units in a water tank, as required by the system of the invention, therefore obtaining more accurate temperature sensing, and improving even more the energy and water saving. Such a manner of assembling the system of the invention is applicable in both existing water heating systems or in newly installed water heating systems It is therefore an object of the invention to increase energy and water savings in a domestic water heating system.

It is another object of the invention to provide to the user better control and more reliable indications relating to the temperature of the water in the tank.

It is still another object of the invention to enable easy installation of the system of the invention, in existing water heating systems, on site.

It is still another object of the invention to provide electrical and electronic failure indications, by visual or audible means.

It is still another object of the invention to provide an easy manner of installation of the system of the invention in new or existing water heating systems. This manner of assembling relates particularly to the introduction and assembling of temperature sensing units in the tank.

It is still another object of the invention to provide new manner by which data is communicated between the temperature sensing unit/s of the tank generally located outside of the house, and the control unit located inside.

SUMMARY OF THE INVENTION

The present invention relates to a method for heating water in a domestic water heating system which comprises: (a) Providing a water tank containing $m_w$ liters of water; (b) Providing at least one temperature unit in said water tank for sensing the temperature of the water in the tank; (c) Providing a heating element in said water tank; (d) Providing a control unit for activating said heating element, said control unit continuously receiving indication of the water temperature from said temperature sensing unit; (e) Providing to sad control unit a desired water temperature, and designating a time for using the water at said desired temperature; (f) Knowing the current water temperature, the desired water temperature at said designated time, the power of the heating element and the specific heat of the water, calculating by the control unit the heating period Δt needed for heating the water in the tank from the current temperature as measured by said temperature sensing unit to the desired temperature; (g) Periodically repeating said calculation and updating said calculated period Δt according to changes in the sensed water temperature; (h) When the designated usage time is approaching, activating the heating element a Δt period before the said designated usage time.

Preferably, the calculation further includes a consideration of the a heat loss factor.

In an embodiment of the invention, the following formula is used by the control unit:

$$\Delta t = \frac{m_w C_p \Delta T}{P_H}$$

Wherein:

Δt is the expected heating period by the heating element [seconds];

$P_H$ is the power of the heating element [Watts];

$m_w$ is the volume of the water in the water tank measured in liters;

$C_p$ is the specific heat capacity of the water $$\left(=4200\ \frac{\text{Joules}}{\text{kg}\cdot{}^\circ\text{ C.}}\right);$$

ΔT is the difference between the designated temperature at a later desired time and the current temperature of the water in the tank, measured in degrees Celsius [° C.].

According to another embodiment of the invention the calculation is made by the following formula:

$$\Delta t = \frac{Km_w C_p \Delta T}{P_H}$$

wherein K is the loss factor;

Preferably, the loss factor K is calculated by the following formula:

$$K = 1 + \frac{m_w}{A}\cdot\frac{\Delta T}{B}\cdot\frac{C}{P_H}$$

Wherein:

A is the volume of the tank used [in liters], B is the difference between the required temperature in the tank and the air temperature surrounding the tank [in ° C. ], and C is the heat lost to the surroundings, [in Watts], as acquired by experimental results.

The invention also relates to a water heating system, which comprises: (a) a water tank; (b) a heating element in said water tank; (c) at least one temperature sensing unit for sensing the temperature of the water in the tank; (d) a control unit located in a place accessible to the user, the control unit receives from said temperature-sensing unit an indication to the current temperature, The control unit further comprises: (I) a display for displaying the current water temperature as acquired by the said temperature sensing unit; (II) a display and push buttons allowing the user to designate time for having hot water at a desired water temperature; (III) calculating means for calculating from the current water temperature, the desired water temperature, the power of the heating element and the specific heat of the water a heating period in which the heating element has to be activated in order to heat the water to the desired water temperature by the heating element; and (IV) switching means for providing voltage to the heating element during said calculated heating period.

Preferably, the temperature-sensing unit comprises at least one temperature sensor having means for transforming a change in temperature into a proportional change in voltage.

Preferably, the said system comprises at least one temperature sensing unit in a form of a tube within the hollow of which at least one temperature sensor is mounted.

Preferably, each temperature sensing unit is introduced into the space of the water tank from within an opening in one of the pipes leading water to or from the tank, and wherein said opening is then sealed in such a manner as to prevent leakage of water through said opening while letting the temperature sensing unit containing measurement wires coming from the sensor/s to penetrate through the sealing.

Preferably, a T-type connector is connected to the pipe with the temperature sensing unit, one end of said T connector forms the said opening with sealing, the other two ends of the said T connector lead water to or from the tank.

Preferably, a cap with a bore is used at the said opening, the bore being sealed by a sealing material, while letting said temperature sensing unit containing measurement wires coming from the sensor/s to penetrate through the sealing.

Preferably, the pipe through which the temperature-sensing unit is introduced into the tank is the pipe leading hot water out from the tank.

Preferably, one temperature sensor is located at the distal end of the temperature-sensing unit, away from the sealed opening and within the space of the tank. In another option, a plurality of temperature sensors may be mounted along the unit, to measure temperatures at different levels of the water in the tank.

Preferably, each temperature sensor provides transformation of a change in temperature into a proportional change in voltage.

In still another embodiment of the invention, two line-transceivers are used, one at a location close to the tank, and the other at a location close to or within the casing of the control unit, for providing transfer of data relating to the temperature of the water in the tank to the control unit, and data from the control unit to an actuator of the heating element located next to the heating element, over the electricity lines supplying current to the heating element. In another alternative, two transceivers are used, one at a location close to the tank, and the other at a location close to or within the casing of the control unit, for providing wireless transfer of data relating to the temperature of the water in the tank to the control unit, and data from the control unit to an actuator of the heating element located next to the heating element.

DETAILED DESCRIPTION OF PREFERRED EMBODIMENTS

Figure 1:
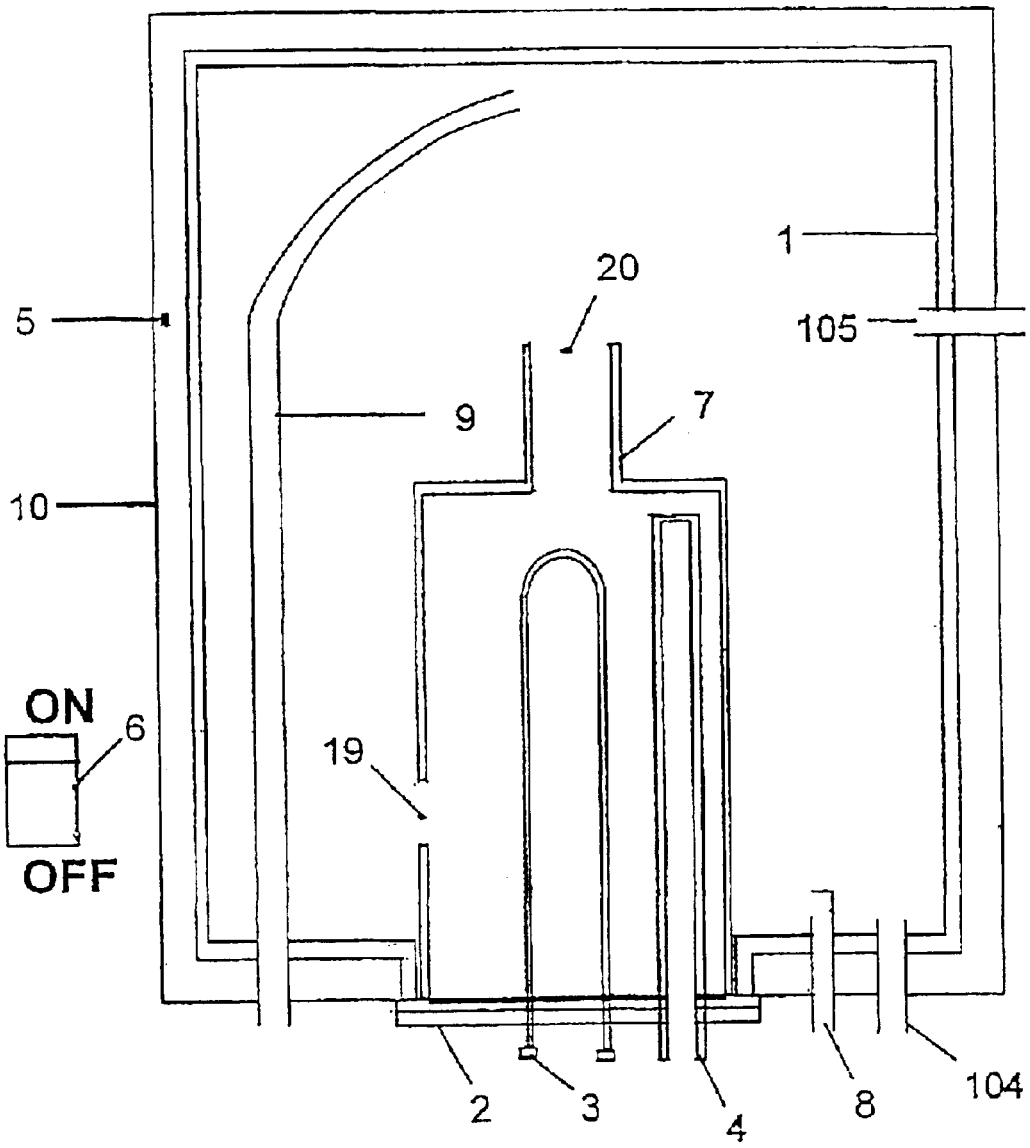
FIG. 1 is a schematic depiction of a domestic water heating system according to the prior art.

The invention provides improvements to domestic water heating systems. More particularly, the system of the invention provides an improved control over the water heating, enabling the user to plan and define in advance the exact temperature of the water in the water tank, and the time at which heated water will be needed at the defined temperature. As said, some of the domestic heating systems of the prior art enable the defining of a desired water temperature at a specific time. However, these systems are either not sufficiently accurate, particularly in determining the exact temperature of the mass amount of the water, or are not optimized in their energy consumption.

The following equations are used in the control unit of the system for defining the required heating period, and the exact starting time in which the heating is initiated:

$$\text{Watts}\cdot\text{sec}=m_w\cdot C_p\cdot\Delta T \quad (1)$$

Wherein:

Watt·sec is the heating energy provided to the water by the heating element;

$m_w$ is the volume of the water in the water tank measured in liters (=Kg);

$C_p$ is the specific heat capacity of the water $$\left(=4200\ \frac{\text{Jouls}}{\text{kg}\cdot{}^\circ\ \text{C.}}\right);$$

ΔT is the difference between the desired temperature at a later desired time and the present temperature of the water in the tank, measured in degrees Celsius [° C.].

$$\Delta t=\frac{K\cdot\text{Watt}\cdot\text{sec}}{P_H} \quad (2)$$

wherein:

Δt is the expected heating duration of the heating element [seconds];

$P_H$ is the power of the heating element installed in the water tank [Watts];

K is an experimental factor which enables the algorithm to accurately calculate the time duration required to heat the water in the tank to the desired temperature. Formula (3) details how K is calculated. It is partially based on actual experiments that were performed by the inventors, taking into account the volume of the water tank ($m_w$), the temperature difference (ΔT), and the power of the heating element ($P_H$).

The control unit calculates the value of K according to the following formula:

$$K=1+\frac{m_W}{A}\cdot\frac{\Delta T}{B}\cdot\frac{C}{P_H} \quad (3)$$

A, B, and C are numerical values obtained by laboratory experiments. A=60 liters, is the volume of the tank used, B=20° C. is the difference between the required temperature in the tank and the air temperature surrounding the thermally insulated tank. C=70 Watts was the heat lost to the surroundings. These values may change by accumulation of experience, and with variations in materials and structure of the water tank.

EXAMPLE 1

An 80 liter water tank having a heating element of 2500 Watts is provided. The present temperature of the water in the tank is 28° C. It is desired that at 19:00 this evening, the water temperature will be 50° C.

$$\Delta T=50-28=22^\circ\ \text{C.}$$

Therefore:

$$\text{Watts}\cdot\text{sec}=80\cdot4200\cdot(50-28)=7.392\cdot10^6\ \text{Joules}$$

$$K=1+\frac{80}{60}\cdot\frac{22}{20}\cdot\frac{70}{2500}=1.041$$

$$\Delta t=\frac{1.041\cdot7.392\cdot10^6}{2500}=3078.2\ \text{sec}\cong52\ \text{min}$$

Therefore, the heating element will be activated at 18:08:00. If the user desires, the program may be set to continue water-heating for a specified duration of time. For example, if the user desires to keep the water in the tank at this temperature for an additional 40 minutes, the heating will resume each time the water temperature drops below 50° C., until 19:40.

According to the invention, the control unit operates continuously, checks the present date, time and temperature of the water in the tank, and calculates when to activate the heating element.

Example 1 shows that the system saves a significant amount of energy in comparison to systems of the prior art which include mechanical/electrical/electronic timers that do not consider the present temperature before activating the heating process. The systems of the prior art thus maintain water in the tank at higher temperatures than needed over long periods. The advantage of the algorithm of the invention is that the water in the tank is heated only towards the required time, in order to reach the exact desired temperature precisely at the set time, and thus heat loss to the environment is minimized. Therefore, the system of the invention provides appreciable energy savings.

The temperature of the water in the tank is measured by a sensing unit mounted in the tank, with data continuously provided to the control unit. The user defines the times, desired temperature, and the time duration to keep the said temperature. The control unit is located in a place convenient to the user and remote from the hot water tank.

In still another embodiment of the invention, the user may define instead of the temperature another temperature related, or water volume related indication, such as the number of showers he plans to use.

The measured water temperature or another temperature related indication is displayed continuously on a front panel of the control unit. The user introduces to the control unit by means of push buttons the desired settings. For example, the user may set a required water temperature, a date and time in which the required water temperature is desired, and the duration for which this temperature is desired.

The control unit retains the user settings in an internal memory. The user can also activate or deactivate the heating directly, or the timer operation of the control unit.

The preferred water temperature sensing unit according to the invention is, for example, PTX type sensor (PT stands for Platinum Temperature, X defines the type of thermistor, like 100, 1000), a thermocouple sensor, a digital thermometer, or any other equivalent temperature-sensing element. Installation of all parts of the system (such as the control unit, the temperature sensing unit, and wires) is simple, and any existing standard domestic water heating system can be upgraded to the system of the invention with relative ease.

The control unit preferably also includes the option of failure detection, which alerts the user of detected failures, such as in the heating element or in the temperature-sensing unit, or the safety devices. Any of the above failures causes automatic termination of the voltage supply to the electric heating element.

Figure 2:
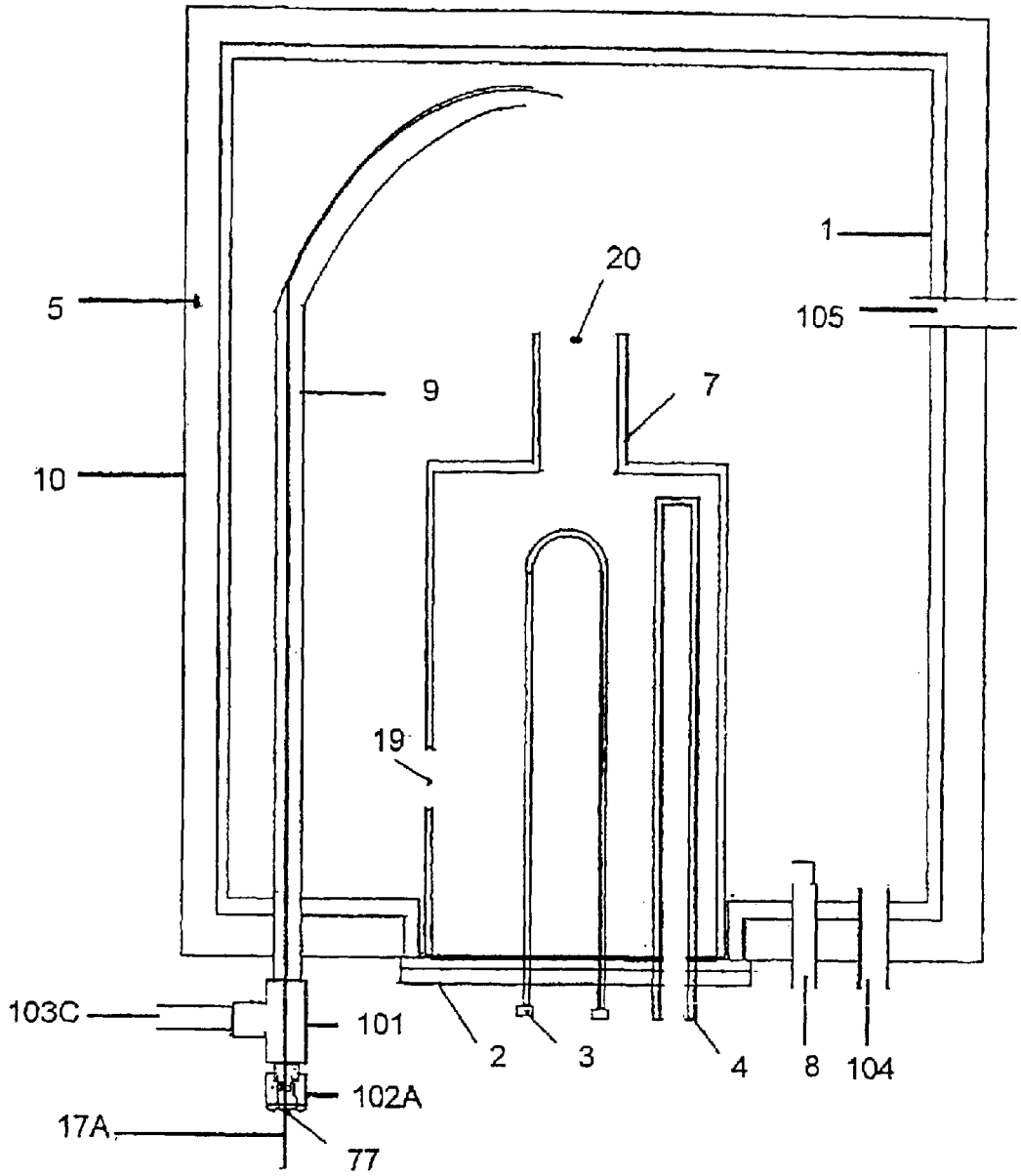
FIG. 2 illustrates an installation of a temperature-sensing unit in a water tank of the type of FIG. 1.
Figure 3:
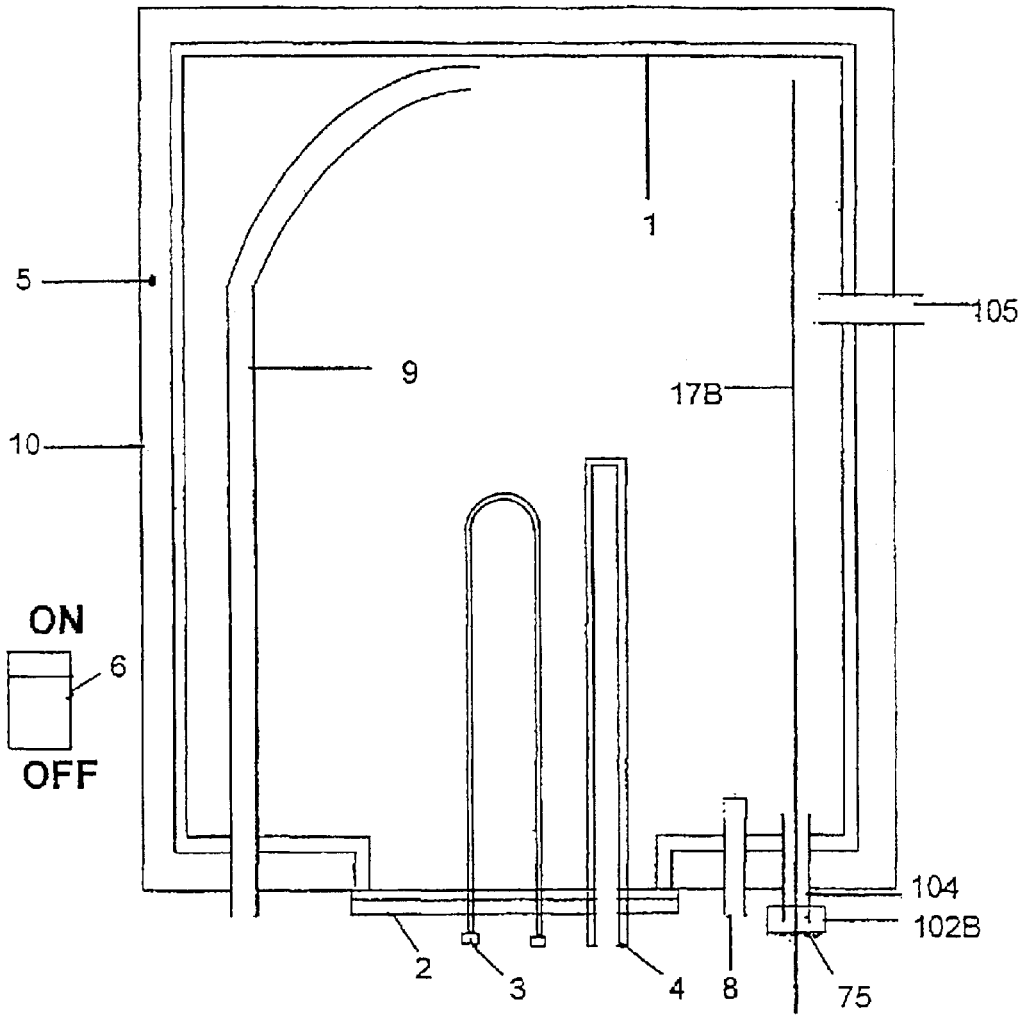
FIG. 3 illustrates an installation of a temperature-sensing unit in a water tank of the type of FIG. 1.

In order to provide best performance of the system of the invention, it is essential to obtain an accurate indication of the water temperature in the tank. In a preferable embodiment of the system of the present invention, a single temperature sensing unit is installed in the water tank. FIGS. 2 and 3 show in schematic form the system according to one embodiment of the invention. A temperature sensing unit 17A or 17B is introduced into the water tank through a water pipe 9 or 104, which is an integral part of the water tank 1.

It should be noted that the temperature-sensing unit 17A or 17B may also be introduced into the water tank in any conventional manner.

FIGS. 2 and 3 show two alternatives by which the temperature-sensing unit is introduced into tank 1 through water pipe 9 or water pipe 104. Sealing nuts 102A in FIG. 2 and 102B in FIG. 3 are used for enabling penetration of the temperature; sensing unit through it, while sealing water leakage.

Figure 4A:
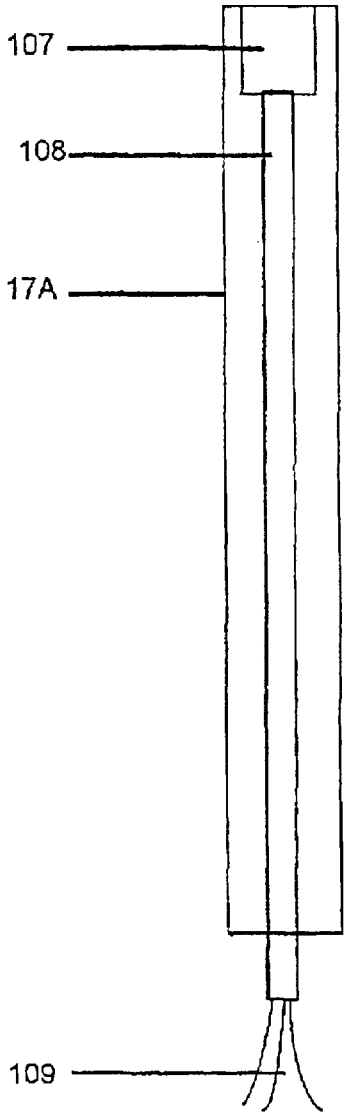
FIG. 4A illustrates a temperature sensing unit with one temperature sensor inside, according to a first embodiment of the invention.
Figure 4B:
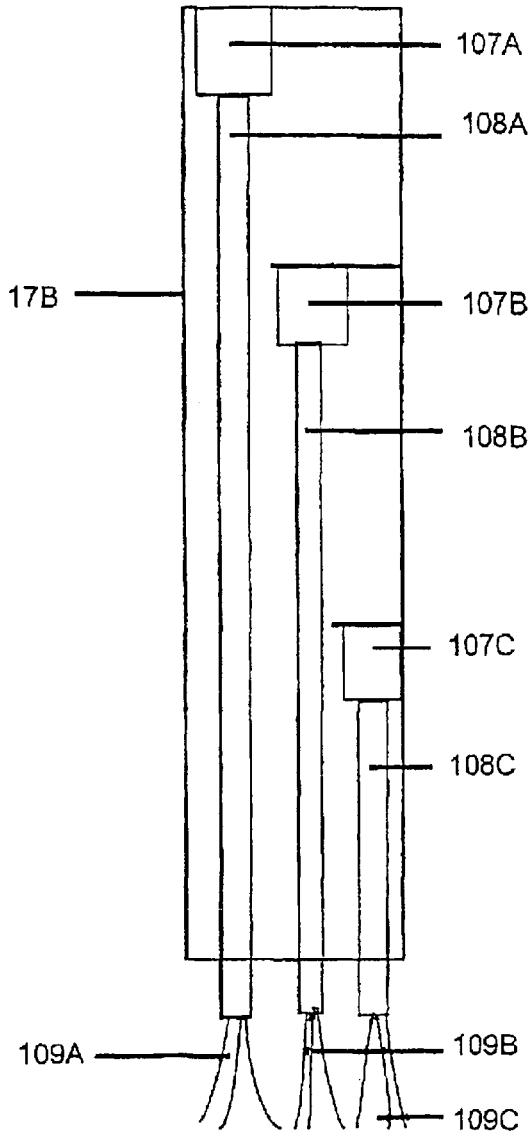
FIG. 4B illustrates a temperature sensing unit with three temperature sensors inside, according to a second embodiment of the invention.

As said, the temperature sensing units 17A and 17B in FIGS. 2, 3 and 4 preferably include a PTX-type sensor, a thermocouple, a digital thermometer, or an equivalent device. This is an important part of the invention, as the immersion of the temperature sensing unit in the water in the tank results in an accurate measurement, and the method of penetration enables easy installation of the temperature sensing unit in standard water tanks. FIG. 4A and FIG. 4B detail two devices: FIG. 4A shows a temperature sensing unit 17A with only one sensor 107 and FIG. 4B shows a sensing unit 17B in a form of a one metal sleeve with multiple temperature sensors 107A, 107B, and 107C installed inside. The sensing unit penetrates through the nuts 102A in FIG. 2 and 102B in FIG. 3 and the nut seals the penetration area. The connecting wires 109 in FIG. 4A, or 109A, 109B and 109C in FIG. 4B direct the temperature measurements of the sensor/s to the control unit.

Some Observations on Temperature Sensor/Sensors:

a. According to an embodiment of the present invention, more than one temperature-sensing unit 17A or 17B can be installed in the water tank.
b. The invention also discloses a domestic water heating system with an improved manner and accuracy of sensing the temperature of the water in the water tank. FIGS. 2 and 3 illustrate two alternatives of installing one temperature sensing unit in the water-heating tank.
c. One or more sensing units can be installed at different locations in the tank to directly measure the water temperature. If more than one sensor is used within one or more sensing units, the algorithm is provided with information relating to which of the sensors or a combination thereof to use, and at what time.

In FIG. 3 a temperature sensing unit 17B is inserted via an existing water pipe 104 into the water tank 1. In some cases, for example, when solar heat collectors are not in use, there may exist unused pipes, in this case pipes 104 and 105, connected to the tank, and are sealed by a cap. According to the invention, a cap is removed, and a temperature-sensing unit 17B is inserted through pipe 104. The temperature-sensing unit may include one or more temperature sensors, for measuring the temperature of the water, at different levels within the tank. Each temperature-sensor is connected to at least two wires for providing electronic indications regarding the temperature it measures. The wires of the temperature sensors are connected to a control circuit (not shown) that controls the activation of the heating system. The cap 102B is preferably a hexagon-shaped cap having a bore 75 in its center. A conventional sealing material is used for sealing around the tube forming the temperature-sensing unit, preventing the passage of water out of the tank.

It should be noted that the diameter or the temperature sensing unit 17B is generally much smaller in comparison with the diameter of pipe 104, essentially in the range of no more than ⅓ or ¼ of the,diameter of the pipe.

The temperature-sensing unit 17A, including the one or more temperature sensors, can optionally be introduced into the water tank via a pipe in use. FIG. 2 shows such a case in which the temperature-sensing unit 17A is introduced into the water tank via the outlet of hot water pipe 9. In that case, a T-connector 101 is used for enabling the introduction, through a first side of it (the side connected to 102A), of the temperature sensing unit 17A into the water tank, while allowing the regular flow of water to pass into the hot water supply pipe 103C. The cap 102A is preferably a hexagon-type cap, similar to the cap 102B of FIG. 3, with a bore 77 through which the temperature sensing unit passes. A sealing material is used to prevent leakage of water through bore 77. The diameter of the temperature sensing unit 17A is essentially small in comparison with the diameter of the pipe 9, not to significantly disturb the flow of the water through pipe 9. It has been found by the inventors that a unit diameter of up to about ⅓ of pipe 9 diameter does not cause a significant disturbance to the flow of water through pipe 9.

It should be noted that the term temperature sensing unit used herein refers to any type of temperature measuring means.

FIGS. 4A and 4B illustrate how the temperature sensors 107 are assembled within temperature sensing unit 17. In FIG. 4A, one temperature sensor 107 is assembled within a temperature-sensing unit 17A. The sensor itself is indicated as numeral 107, and numeral 108 indicates a sleeve that encloses the electrical wires 109, that are connected to a control circuit that controls the activation of the heating when necessary. The upper portion of temperature sensing unit 17A is positioned in the water tank, and the wires 109 are outside the water tank, being connected to the control circuit (not shown). FIG. 4B similarly illustrates how multiple sensors, for example three sensors 107A, 107B, and 107C are assembled within the temperature-sensing unit 17B, at different heights, for enabling the temperature measurement at different levels of the water within the tank.

Preferably, the temperature sensors are of the type PTX, or a digital thermometer, having each between two to four output wires 109.

According to a preferred embodiment of the invention the existing thermostat located in pocket 4 of the tank 1 is used only as a safety device to terminate the electric current flow in case the maximal value set for the water temperature in the tank is exceeded.

As said, in a preferable embodiment of the invention the insertion of the temperature sensing unit is made through an existing opening of a water pipe. Moreover, the temperature measuring has been found by the inventors to be much more accurate due to the following reasons:

a. The temperature sensing unit is inserted inside the water tank and preferably, there is a direct contact between the sensing device and the water.
b. One or more temperature sensors can be designed to be mounted essentially at any height, and at almost any location within the water tank.

The invention provides a method for introducing one or more temperature sensors within one or more temperature sensing units into a water tank. The manner of such introduction is useful in both existing water tanks and in future water tanks. In the first case, such introduction of the temperature sensing unit/s provides a more accurate measuring. In the latter case, such introduction of the temperature sensing unit/s also eliminates the need to provide a dedicated pocket for a temperature-sensing device, therefore reducing the cost of production of the tank. Moreover, such manner of introduction is simple, and can be easily carried out into practice at low cost.

The present invention requires a transfer of temperature data from the temperature sensing unit/s that is frequently located remotely, for example, on the roof of the house (or building), while the control unit is generally located inside the home of the user. Furthermore, it requires the transfer of electricity from the control unit to the heating element at the tank. This generally requires the introduction of at least two additional wires for conveying data from the water tank to the control unit and vice versa. When installing the system of the present invention in new houses, this involves generally only slightly additional costs. However, when upgrading heating systems of the prior art to operate according to the invention, the introduction of the two additional wires is a relatively complicated task. The present invention provides a solution also to this problem. According to a preferred embodiment of the invention two transceivers are introduced, one in the roof, and one inside the house to convey data information between the roof and the control unit over the electrical lines leading electricity from the control unit to the heating element. Therefore, according to this embodiment the same electrical lines are used both for the transfer of electricity to the heating element, and both for the transfer of temperature information from the tank to the control unit. Such transceivers are known in the art. For example, transceivers of the type TDA 5051 by Philips Company can be used.

General: The control unit comprises a display, software for operating the unit, electronic components, and electrical and mechanical components. The algorithm according to which the unit operates is based on the formulas as given hereinbefore. As said, the algorithm uses at least three main parameters in order to calculate when and for how long to activate the heating: (a) the water temperature before the heating; (b) the known specific heat of the water; (c) the desired water temperature at the time when the hot water is to be used; and (d) the known power of the heating element used.

Hereinafter, several variants and examples of the invention will be described.

$1^{st}$ variant: a standard system, the control unit including software for enabling two modes of operation, manual or automatic.

Figure 5:
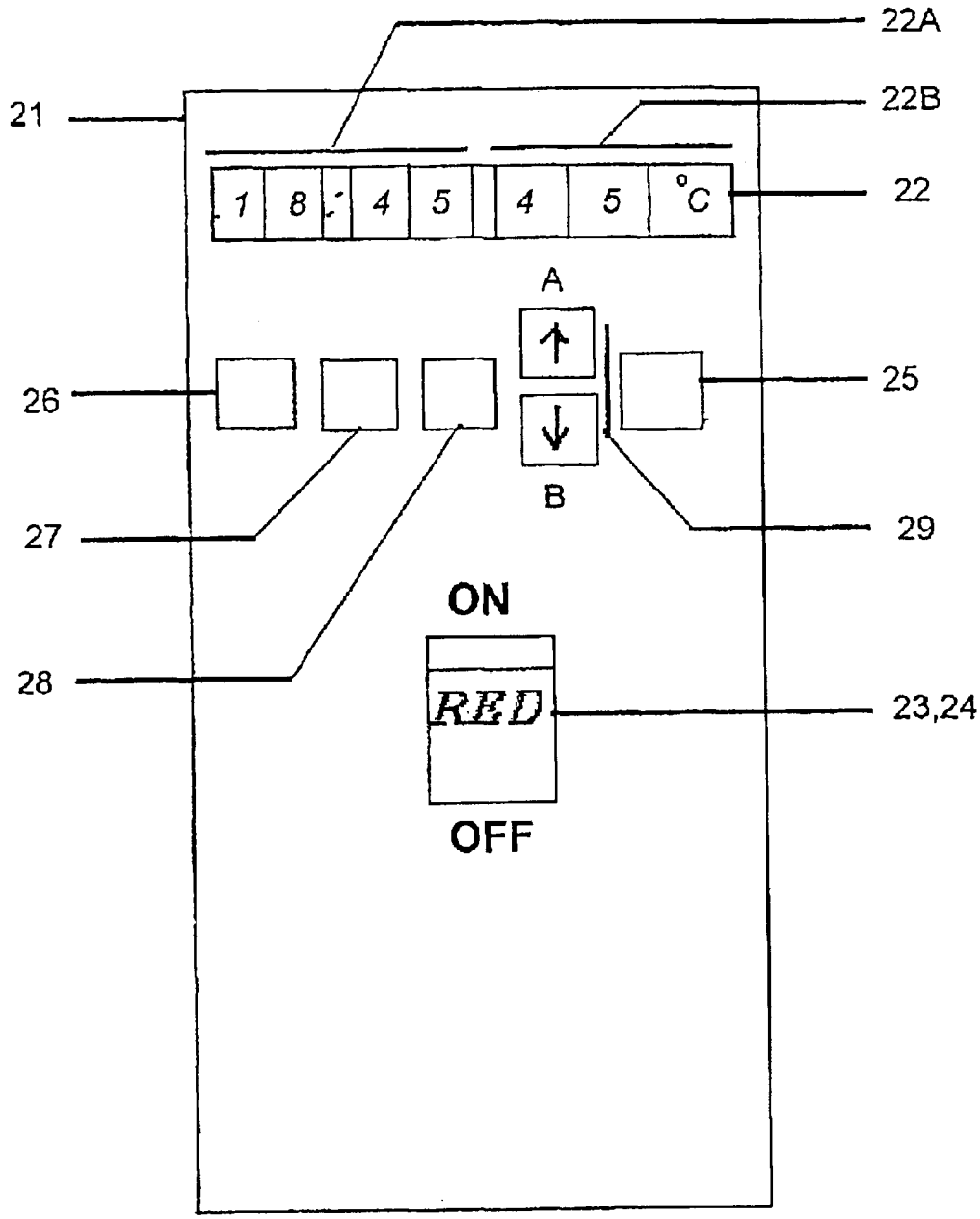
FIG. 5 describes an exemplary front panel of the control unit, including the display and push buttons according to the first (most common) alternative

Manual activation is provided by setting the ON/OFF switch 23 in FIG. 5 to the ON position, thereby enabling the control unit to activate the heating element. The heating terminates either by manually turning OFF switch 23, or by the control unit when the desired water temperature in the tank, as programmed by the user, has been reached The programming of the control unit is performed by the user, using the display and the buttons of the unit.

It should be noted that this is a basic alternative of the control unit and it can be modified by means of software and/or hardware to be even more user-friendly.

FIG. 5 shows a first possible structure for control panel 21 of the control unit. Control panel 21 comprises a numeric display 22, showing the time 22A (hour:minutes), and the current temperature in the tank 22B (or another display related to the water temperature e.g. number of showers). Switch 23 activates the heating system When switch 23 is ON, the control unit operates, to activate the heating element when needed. The digital display 22 functions always, whether switch 23 is ON or OFF. Red light 24 is activated when current flows through the heating element and it turns OFF when no current passes through it. The first push button 26 is used for setting the current time. The second push button 25 functions as follows: when activated, the threshold value of the desired water temperature appears on display 22B. The third push button 27 functions as follows: when activated, the desired time at which water at said threshold temperature is needed appears on the display 22A The fourth push button 28 functions as follows: when activated, display 22A registers the additional duration at which the threshold temperature should exist in the water tank. The fifth and sixth push buttons 29A and 29B are adjustment buttons, button 29A upward and button 29B downward, respectively.

a. When pushing button 25 and one of buttons 29A or 29B the threshold temperature changes on the display 22B: Note that the threshold temperature cannot exceed a preset value, 65° C. for example, particularly for the sake of safety.

b. When pushing button 26 and one of buttons 29A or 29B, the current time can be adjusted.

c. When pushing button 27 and one of buttons 29A or 29B, the desired time for using the water can be adjusted.

d. When pushing button 28 and one of buttons 29A or 29B, the additional duration for which the threshold temperature should be maintained in the tank can be adjusted.

Figure 6:
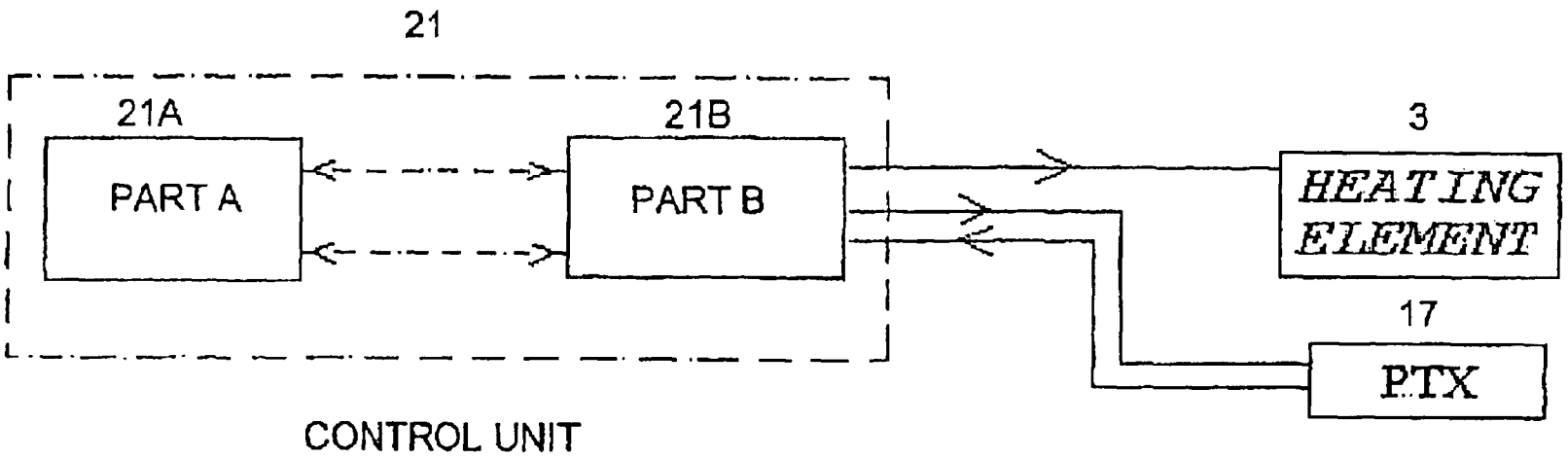
FIG. 6 shows an embodiment of the invention in which the control unit is split into 2 parts, using transceivers for conveying information between the two parts.

$2^{nd}$ Variant: In this alternative the control unit is divided into two parts, the first part is located in convenient location for the user and it will be called part A 21A and the second will be called part B 21B in FIG. 6 and is located very near the water tank The communication between part A and part B (in both directions) is performed by means of a Current Transceiver, a C Bus or another standard electronic device which is capable of communicating digital information between two control units, which use the power lines of one phase serving the heating element 3 of the water tank. Within part A are the water temperature display (or another display related to water temperature, e.g. number of showers), time display, the different push-buttons, software and a digital information transmitter/receiver. In part B is the final component which delivers current to the heating element 3 in the water tank, the water temperature electronic system connection to the temperature sensing unit 17 and a digital information transmitter/receiver.

Figure 7A:
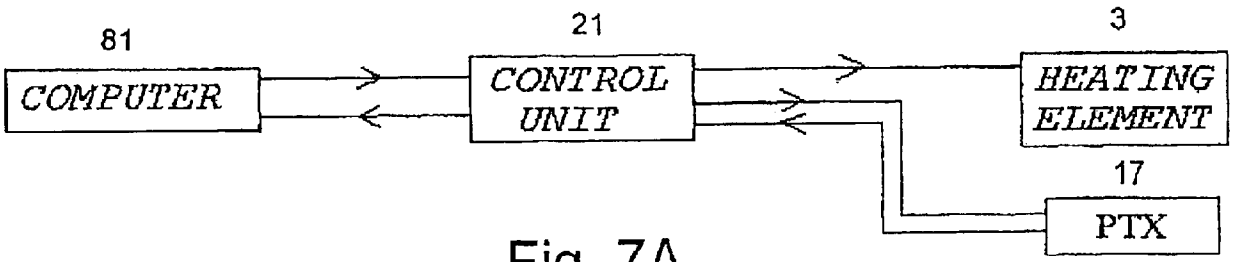
FIG. 7A shows an embodiment of the invention in which a computer commands the control unit.

$3^{rd}$ Variant: FIG. 7A shows a configuration that comprises a conventional computer (PC). The control unit 21 is connected to a PC 81 via any conventional communication means. Any setup of the control unit 21, can be performed from the PC, and the information relating to the current status of the water tank can be transferred and displayed on the screen of the PC. For that purpose, a dedicated software should reside at the PC.

Figure 7B:
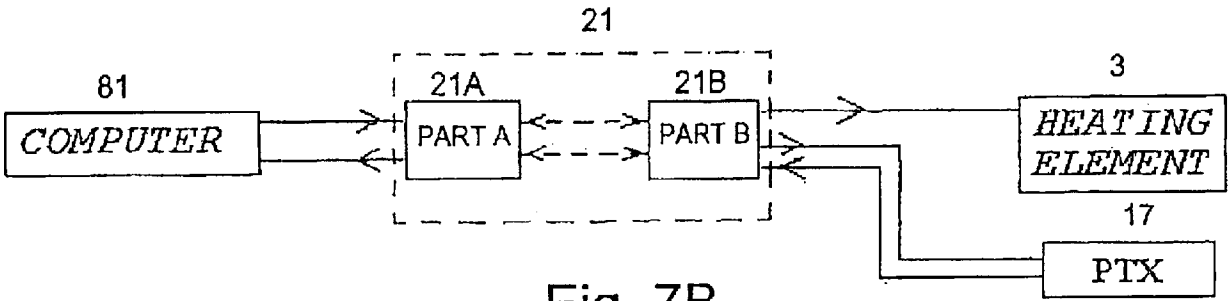
FIG. 7B shows another embodiment of the invention in which a computer controls an embodiment as shown in FIG. 6.

$4^{th}$ Variant: FIG. 7B shows a variant of the invention, in which the whole control unit is embodied by a PC. The communication between the PC and the tank is carried out by means of transceivers 21A and 21B, that transfer data over the electricity lines.

EXAMPLE 2

It is desired to have water in the tank in a temperature of 50° C. at 19:00. The present temperature in the tank is 28° C. The control unit uses the algorithm to calculate the time duration required for the heating element to heat the water up to 50° C. The present calculation, using the algorithm of formula (2), results in 52 minutes of heating. The software continuously checks the calculation until 19:00 minus 52 minutes=18:08. At the calculated time 18:08 (if the temperature in the tank is still 28° C.), the heating element is activated automatically by the control unit. At 19:00, when the temperature reaches the desired temperature of 50° C., the control unit terminates the heating. If during the heating, i.e., between 18:08 and 19:00, hot water is consumed from the tank, and therefore the water temperature at 19:00 is found to be lower than the desired, the control unit continues to activate the heating element, until the water temperature reaches the desired temperature. Furthermore, the user may be provided with the option of programming the unit to continue providing hot water at 50° C. in a consuming duration of, for example, 40 minutes. In that case, the water will be heated to 50° C. at 19:00, and any time between 19:00 and 19:40 when the temperature drops below 50° C., the control unit activates the heating element 3.

While some embodiments have been illustrated by means of the above examples, it should be understood that the invention may be carried out with many variations, modifications and adaptations, without departing from its spirit or exceeding the scope of the claims.

What is claimed is:

1. A method for heating water in a domestic water heating system, comprising:

Providing a water tank containing $m_w$ liters of water;

Providing at least one temperature sensing unit in said water tank for sensing the temperature of the water in the tank;

Providing a heating element in said water tank;

Providing a control unit for activating said heating element, said control unit continuously receiving indication for the water temperature from said temperature sensing unit;

Providing to said control unit a desired water temperature, and designating a time for using the water at said desired temperature;

Knowing the current water temperature, the desired water temperature at said designated time, the power of the heating element, and the specific heat of the water, calculating by the control unit the heating period Δt needed for heating the water in the tank from the current temperature as measured by said temperature sensing unit, to the desired temperature;

Periodically repeating said calculation and updating said calculated period Δt according to changes in the sensed water temperature; and When the designated usage time is approaching, activating the heating element a Δt period before the said designated usage time.

2. A method according to claim 1, further including in the calculation a heat loss factor.

3. A method according to claim 1, wherein the formula used by the control unit is:

$$\Delta t = \frac{m_w C_p \Delta T}{P_H}$$

Wherein:

Δt is the expected heating period by the heating element [seconds];

$P_H$ is the power of the heating element [Watts];

$m_w$ is the volume of the water in the water tank measured in liters;

$C_p$ is the specific heat capacity of the water $$\left(= 4200 \ \frac{\text{Joules}}{\text{kg} \cdot {}^\circ\text{ C.}}\right);$$

ΔT is the difference between the designated temperature at a later desired time and the current temperature of the water in the tank, measured in degrees Celsius [° C.].

4. A method according to claim 2, wherein the calculation is made by the following formula:

$$\Delta t = \frac{K m_w C_p \Delta T}{P_H}$$

wherein K is the loss factor.

5. A method according to claim 4, wherein the loss factor K is calculated by the following formula:

$$K = 1 + \frac{m_w}{A} \cdot \frac{\Delta T}{B} \cdot \frac{C}{P_H}$$

Wherein:

A is the volume of the tank used [in liters], B is the difference between the required temperature in the tank and the air temperature surrounding the tank [in ° C.], and C is the heat lost to the surroundings [in Watts], as acquired by experimental results.

6. A domestic water heating system comprising:

a water tank;

a heating element in said water tank;

at least one temperature sensing unit for sensing the temperature of the water in the tank;

a control unit located in a place accessible to the user, the control unit receives from said temperature-sensing unit an indication to the current temperature, the control unit further comprises:

a display for displaying the current water temperature as acquired by the said temperature sensing unit;

a display and push buttons allowing the user to designate time for having hot water at a desired water temperature;

calculating means for calculating from the current water temperature, the desired water temperature, the power of the heating element and the specific heat of the water a heating period in which the heating element has to be activated in order to heat the water to the desired water temperature by the heating element; and switching means for providing voltage to the heating element during said calculated heating period.

7. A domestic water heating system according to claim 6 wherein the temperature-sensing unit comprises at least one temperature sensor, having means for transforming a change in temperature into a proportional change in voltage.

8. A domestic water heating system according to claim 6 comprising at least one temperature sensing unit in a form of a tube within the hollow of which at least one temperature sensor is mounted.

9. A heating system according to claim 8, wherein each temperature sensing unit is introduced into the space of the water tank from within an opening in one of the pipes leading water to or from the tank, and wherein said opening is then sealed in such a manner as to prevent leakage of water through said opening while letting the temperature sensing unit containing measurement wires coming from the sensor/s to penetrate through the sealing.

10. A system according to claim 9 wherein a T connector is connected to the pipe with the temperature sensing unit, one end of said T connector forms the said opening with sealing, the other two ends of the said T connector lead water to or from the tank.

11. A system according to claim 9 wherein a cap with a bore is used at the said opening, the bore being sealed by a sealing material, while letting said temperature sensing unit containing measurement wires coming from the sensor/s to penetrate through the sealing.

12. A system according to claim 9 wherein the pipe through which the temperature-sensing unit is introduced into the tank is the pipe leading hot water out from the tank.

13. A system according to claim 9 wherein one temperature sensor is located at the distal end of the temperature-sensing unit, away from the sealed opening and within the space of the tank.

14. A system according to claim 9 wherein a plurality of temperature sensors are mounted along the unit, to measure temperatures at different levels of the water in the tank.

15. A system according to claim 9, wherein each temperature sensor transforms a change in temperature into a proportional change in voltage.

16. A system according to claim 6, further comprising two line-transceivers, one at a location close to the tank, and the other at a location close to or within the casing of the control unit, for providing transfer of data relating to the temperature of the water in the tank to the control unit, and data from the control unit to an actuator of the heating element located next to the heating element, over the electricity lines supplying current to the heating element.

17. A system according to claim 6, further comprising two transceivers, one at a location close to the tank, and the other at a location close to or within the casing of the control unit, for providing wireless transfer of data relating to the temperature of the water in the tank to the control unit.

* * * * *